US008161877B1

(12) United States Patent
Frickey et al.

(10) Patent No.: US 8,161,877 B1
(45) Date of Patent: Apr. 24, 2012

(54) ELECTRONIC FIRING SYSTEMS AND METHODS FOR FIRING A DEVICE

(75) Inventors: Steven J. Frickey, Boise, ID (US); John M. Svoboda, Idaho Falls, ID (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 342 days.

(21) Appl. No.: 12/630,838

(22) Filed: Dec. 3, 2009

Related U.S. Application Data

(63) Continuation-in-part of application No. 11/297,001, filed on Dec. 7, 2005, now abandoned.

(51) Int. Cl.
*C06C 5/06* (2006.01)

(52) U.S. Cl. ..... 102/202.5

(58) Field of Classification Search ..... 102/202, 102/202.1, 202.5, 202.14, 206, 218, 220, 102/275.1, 275.2, 275.3, 275.4, 275.5, 275.6
See application file for complete search history.

(56) References Cited

U.S. PATENT DOCUMENTS

| | | | | |
|---|---|---|---|---|
| 4,445,435 | A | 5/1984 | Oswald | |
| 5,014,622 | A | 5/1991 | Jullian | |
| 5,363,765 | A | 11/1994 | Aikou et al. | |
| 5,377,592 | A * | 1/1995 | Rode et al. | 102/210 |
| 5,425,570 | A | 6/1995 | Wilkinson | |
| 5,435,248 | A * | 7/1995 | Rode et al. | 102/210 |
| 5,929,368 | A | 7/1999 | Ewick | |
| 6,260,483 | B1 | 7/2001 | Snyder | |
| 6,546,873 | B1 * | 4/2003 | Andrejkovics et al. | 102/200 |
| 7,451,700 | B1 * | 11/2008 | Land | 102/218 |
| 7,665,401 | B2 * | 2/2010 | Ballantine et al. | 102/275.11 |
| 7,814,833 | B1 * | 10/2010 | Land | 102/275.6 |
| 2006/0027119 | A1 | 2/2006 | Bossarte et al. | |
| 2007/0125256 | A1 * | 6/2007 | Frickey et al. | 102/205 |
| 2008/0276818 | A1 * | 11/2008 | Ballantine et al. | 102/202.1 |
| 2008/0282922 | A1 * | 11/2008 | Land | 102/218 |
| 2010/0251917 | A1 * | 10/2010 | Land | 102/204 |

OTHER PUBLICATIONS

PCT International Search Report and Written Opinion of International Searching Authority, mailed Aug. 21, 2008.

* cited by examiner

*Primary Examiner* — Troy Chambers
(74) *Attorney, Agent, or Firm* — Michael J. Dobbs; Daniel D. Park; John T. Lucas

(57) ABSTRACT

An electronic firing system comprising a control system, a charging system, an electrical energy storage device, a shock tube firing circuit, a shock tube connector, a blasting cap firing circuit, and a blasting cap connector. The control system controls the charging system, which charges the electrical energy storage device. The control system also controls the shock tube firing circuit and the blasting cap firing circuit. When desired, the control system signals the shock tube firing circuit or blasting cap firing circuit to electrically connect the electrical energy storage device to the shock tube connector or the blasting cap connector respectively.

19 Claims, 5 Drawing Sheets

ELECTRONIC FIRING SYSTEMS AND METHODS FOR FIRING A DEVICE

CROSS REFERENCE TO RELATED APPLICATIONS

This application is a continuation-in-part of prior application Ser. No. 11/297,001, now abandoned filed Dec. 7, 2005, and is hereby fully incorporate by reference.

CONTRACTUAL ORIGIN OF THE INVENTION

The United States Government has certain rights in the invention pursuant to Contract No. DE-AC07-051D14517 between the United States Department of Energy and Battelle Energy Alliance.

TECHNICAL FIELD

This invention relates to initiating circuits in general and more specifically to methods and apparatus for the time-delayed initiation of explosive devices.

BACKGROUND

Numerous types of firing devices and systems have been developed and are being used that are suitable for firing or initiating a wide range of explosive devices, such as, for example, shock tubes and blasting caps. A typical firing system is provided with an electrical energy storage device, such as a capacitor, which stores the electrical energy needed to initiate or fire the device. Many such firing devices are also provided with a delay or a countdown circuit that may be set by a user to delay the initiation (i.e., firing) of the device for some period of time after the system is armed. Alternatively, the firing system may be actuated by remote means, such as, for example, via a radio signal.

Unfortunately, however, such firing systems are not without their problems. For example, many firing systems begin charging the electrical energy storage device (e.g., a capacitor) directly in response to a user input (e.g., when the user initiates the countdown). However, if the selected countdown time is relatively long, such a control schedule means that the electrical energy storage device may be charged for a time period that is considerably longer than the countdown time. Consequently, the firing system will be capable of initiating the device well in advance of the desired time, which can lead to pre-mature firings and can present problems if the user decides to abort the countdown.

In addition, while many firing systems are used in carefully controlled environments wherein a user will have ample time to ensure the proper setting and operation of the firing system, other environments, such as law-enforcement and/or military environments, often do not lend themselves to the careful and considered use of such devices. Consequently, there is a continuing need to ensure that such firing systems are easy to use and operate, while minimizing the chances for mis-programming and/or undesired results if time is short.

SUMMARY OF THE INVENTION

An electronic firing system comprising a control system, a charging system, an electrical energy storage device, a shock tube firing circuit, a shock tube connector, a blasting cap firing circuit, and a blasting cap connector. The control system is connected to the electrical energy storage device, the shock tube firing circuit, and the blasting cap firing circuit.

The electrical energy storage device is electrically connected to the input of the shock tube firing circuit and the input of the blasting cap firing circuit. The shock tube connector preferably shares an electrical ground with the electrical energy storage device and is connected to the output of the shock tube firing circuit. The blasting cap connector preferably shares an electrical ground with the electrical energy storage device and is connected to the output of the blasting cap firing circuit.

The control system controls the charging system, which charges the electrical energy storage device. The control system also controls the shock tube firing circuit and the blasting cap firing circuit. When desired, the control system signals the shock tube firing circuit or blasting cap firing circuit to electrically connect the electrical energy storage device to the shock tube connector or the blasting cap connector respectively.

A preferred embodiment also includes a detection system and a discharge system. The detection system is electrically connected to the blasting cap and detects the presence of a blasting cap connected to the blasting cap connector. The discharge system is connected to the control system and the electrical energy storage device for safely discharging the electrical energy storage device.

A method for firing a device may include the steps of: Operatively connecting the device to an electronic firing system, the electronic firing system including at least an electrical energy storage device, a firing circuit, a control system, and a user interface operatively associated with the control system; operating the user interface to enter an operational mode; setting a countdown time; and initiating a countdown, the control system charging the electrical energy storage device during the countdown, the control system operating the firing circuit to fire the device when the countdown reaches zero.

A method for operating an electronic firing system may include the steps of: Initiating a countdown; charging an electrical energy storage system while performing the countdown; detecting whether a device to be fired is connected to a firing terminal of said electronic firing system; and energizing the firing terminal to which is connected the device to be fired when the countdown reaches zero.

BRIEF DESCRIPTION OF THE DRAWING

Illustrative and presently preferred embodiment of the invention are shown in the accompanying drawing in which.

DETAILED DESCRIPTION OF THE PREFERRED EMBODIMENTS

An electronic firing system comprising a control system, a charging system, an electrical energy storage device, a shock tube firing circuit, a shock tube connector, a blasting cap firing circuit, and a blasting cap connector. The control system is connected to the electrical energy storage device, the shock tube firing circuit, and the blasting cap firing circuit. The electrical energy storage device is electrically connected to the input of the shock tube firing circuit and the input of the blasting cap firing circuit. The shock tube connector preferably shares an electrical ground with the electrical energy storage device and is connected to the output of the shock tube firing circuit. The blasting cap connector preferably shares an electrical ground with the electrical energy storage device and is connected to the output of the blasting cap firing circuit.

The control system controls the charging system, which charges the electrical energy storage device. The control system also controls the shock tube firing circuit and the blasting cap firing circuit. When desired, the control system signals the shock tube firing circuit or blasting cap firing circuit to electrically connect the electrical energy storage device to the shock tube connector or the blasting cap connector respectively.

A preferred embodiment also includes a detection system and a discharge system. The detection system is electrically connected to the blasting cap and detects the presence of a blasting cap connected to the blasting cap connector. The discharge system is connected to the control system and the electrical energy storage device for safely discharging the electrical energy storage device.

Figure 1:
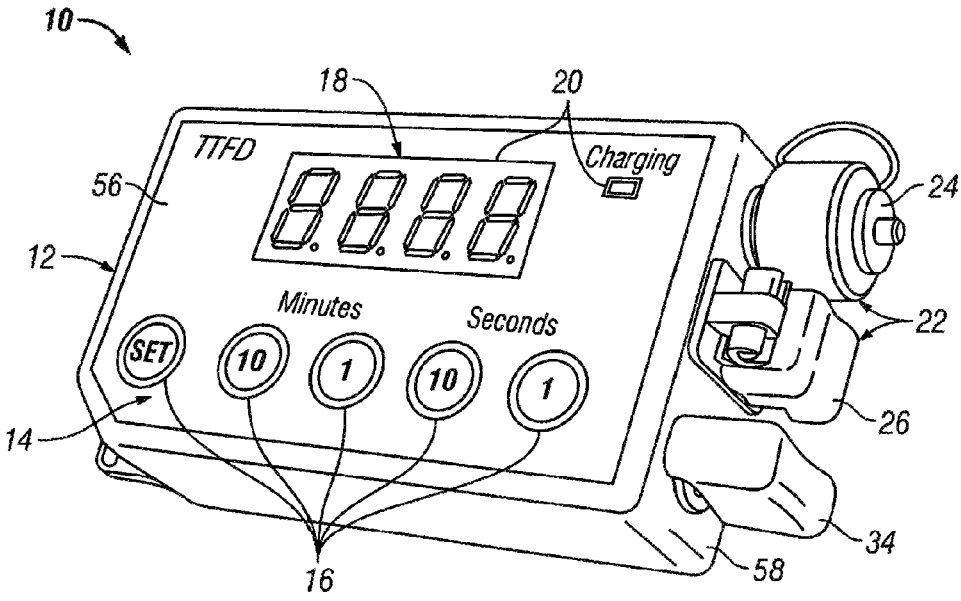
FIG. 1 is a perspective view of one embodiment of an electronic firing system according to the present invention.
Figure 2:
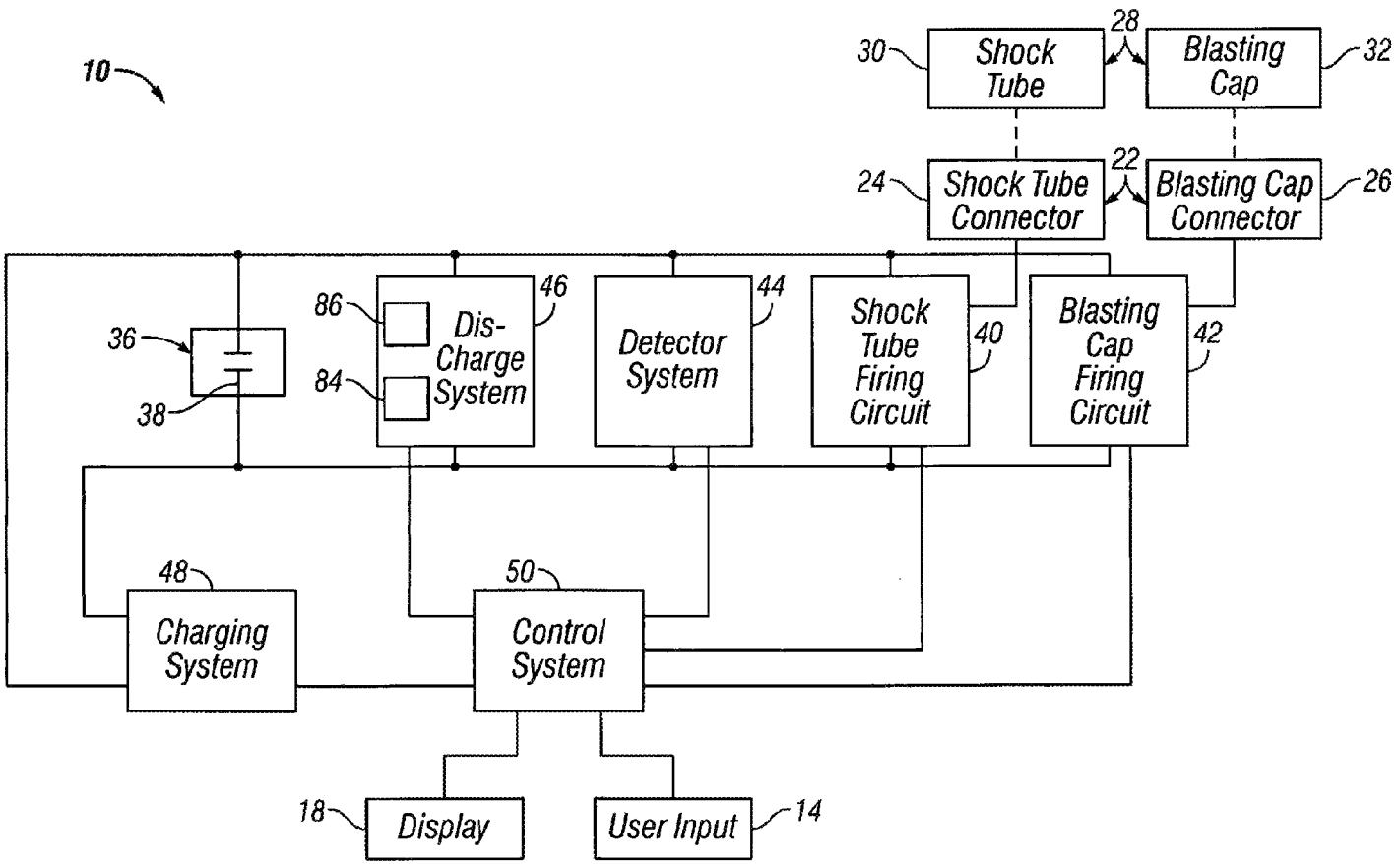
FIG. 2 is a block diagram of one embodiment of the electronic firing system.

One embodiment of an electronic firing system 10 is best seen in FIGS. 1 and 2 and may comprise a number of systems and components operatively associated with a housing 12. For example, in one embodiment, the housing 12 of electronic firing system 10 may be provided with a user input system 14 comprising one or more keys 16, and a display system 18 comprising an LED display 20. The electronic firing system 10 may also be provided with one or more output terminals or connectors 22, such as shock tube connector 24 and blasting cap connector 26, to allow a device to be fired 28 (illustrated schematically in FIG. 2), such as a shock tube 30 or a blasting cap 32 (both of which are also illustrated schematically in FIG. 2) to be connected to the electronic firing system 10. The electronic firing system 10 may also be provided with an arm key 34 to allow the electronic firing system 10 to be operated, armed, and disarmed in accordance with the teachings provided herein.

Referring now primarily to FIG. 2, the electronic firing system 10 may also comprise an electrical energy storage device 36, such as a capacitor 38, as well as a shock tube firing circuit 40 and a blasting cap firing circuit 42. As will be described in greater detail below, the firing circuits 40 and 42 may be operated to electrically connect the electrical energy storage device 36 to the device to be fired 28 (e.g., a shock tube 30 or a blasting cap 32). The electronic firing system 10 may also comprise a detector system 44 for detecting whether a device to be fired 28 is connected to the firing circuits 40, 42. For example, in one embodiment, the detector system 44 detects whether a blasting cap 32 is connected to the blasting cap firing circuit 42. If so, the blasting cap firing circuit 42 will be fired or activated. If not, the shock tube firing circuit 40 will be fired or activated.

The electronic firing system 10 may also be provided with a discharge system 46 for discharging the electrical energy storage device 36, thereby preventing the unwanted retention of electric charge (e.g., energy) within electronic firing system 10. A charging system 48 may also be provided to charge the electrical energy storage device 36. The electronic firing system 10 may also be provided with a control system 50 for controlling the function and operation of the various devices and systems comprising the electronic firing system 10.

Figure 4:
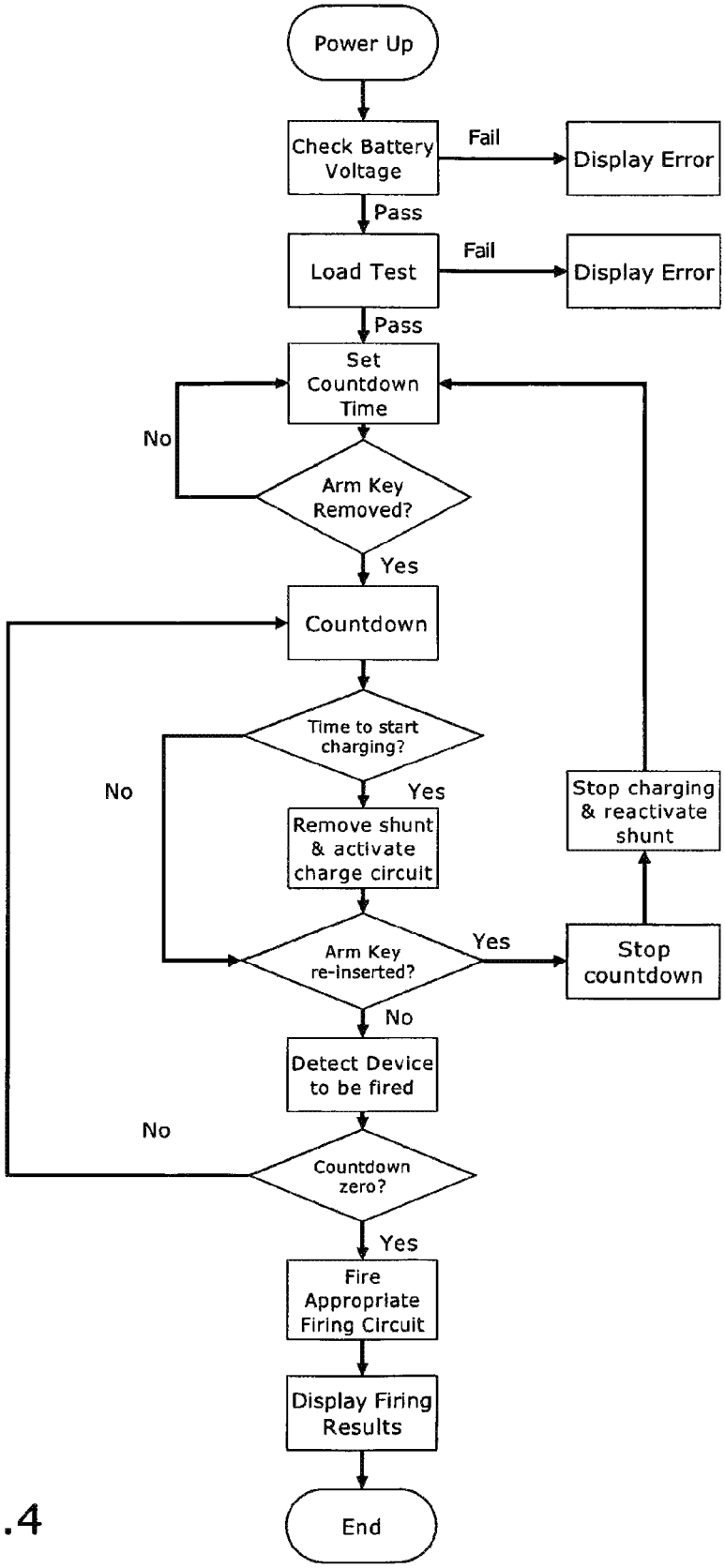
FIG. 4 is a flow diagram of one embodiment of a method for firing a device.
Figure 5:
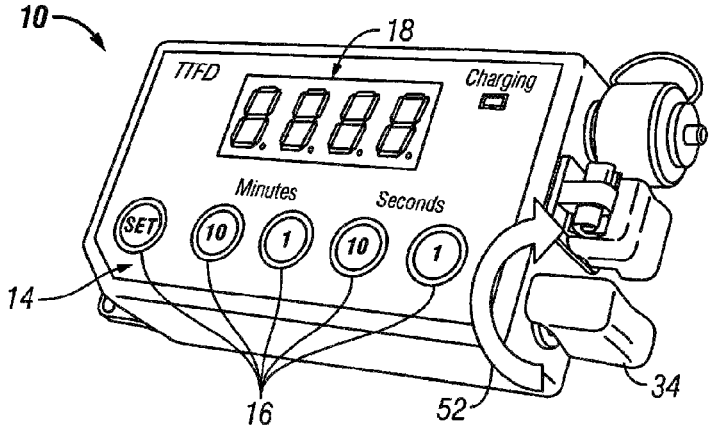
FIG. 5 is a perspective view of one embodiment of an electronic firing system showing the rotation of the arm key from an "off" position to an "on" position.
Figure 6:
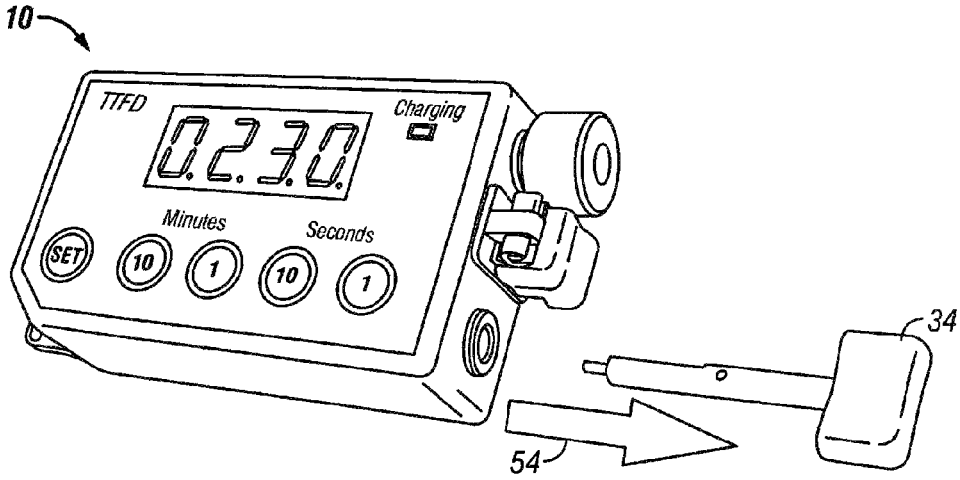
FIG. 6 is a perspective view of one embodiment of an electronic firing system showing the removal of the arm key to arm the electronic firing system.

With reference now to FIG. 4, the electronic firing system 10 may be operated as follows to fire (i.e., initiate) a device to be fired 28 (FIG. 2) that may be connected to the electronic firing system 10. Assuming that a device to be fired 28, such as, for example, as shock tube 30 or a blasting cap 32, is operatively connected to either the shock tube connector 24 or the blasting cap connector 26, as the case may be, the electronic firing system 10 may be activated by rotating the arm key 34 from an "off" position to an "on" position, i.e., generally in the direction of arrow 52. See FIG. 5. A user may then set a delay or countdown time by activating various keys 16 of the user input system 14. Preferably, the user must use a plurality of keys to set a delay to prevent any accidental changes. In a preferred embodiment, the user must hold down a "set" key while other keys are manipulated in order to set the delay time. The selected delay or countdown time will then be displayed on the display system 18. Alternatively, a default countdown time may be selected. The user then may initiate the countdown process by removing the arm key 34 from the housing 12, i.e., generally in the direction of arrow 54. See FIG. 6. Removal of the arm key 34 causes the control system 50 to take over the function and operation of the various systems and components of the electronic firing system 10.

For example, in one embodiment, upon removal of the arm key 34, the control system 50 will, at the appropriate time during the countdown, activate the charging system 48 to initiate charging of the capacitor 38. Preferably, the charging system 48 initiates charging of the capacitor 38 before the countdown reaches zero, but as close as reliably possible. Control system 50 may also monitor the charging process to ensure that the capacitor 38 remains fully charged. In addition, the control system 50, working in conjunction with the detector system 44, may determine whether a blasting cap 32 is connected to the blasting cap connector 26. If a blasting cap 32 is detected, the control system 50 will activate the blasting cap firing circuit 42 when the countdown reaches zero. If no blasting cap 32 is detected, then the control system 50 will activate the shock tube firing circuit 40 when the countdown reaches zero. The control system 50 may also monitor the firing process and provide an indication on the display system 18 about whether the firing process was successful and which device was fired.

As mentioned above, the electronic firing system 10 may also be provided with a discharge system 46. In one embodiment, the discharge system 46 may be provided with an active discharge system that may be operated by the control system 50 to discharge the electrical energy storage device 36 in response to a command from control system 50. Such a discharge may be desirable if, for example, a user wishes to abort the countdown process by re-inserting arm key 34 during the countdown process. The discharge system 46 may also be provided with a passive discharge system which discharges the capacitor 38 without the need for a specific command from the control system 50. Still other discharging operations and functions are possible, as will be described in greater detail below.

Significant advantages and features are associated with the electronic firing system 10 and methods for firing a device. For example, the detector system 44 may be used to automatically detect whether a device to be fired 28 is connected to the output connectors 22 of the electronic firing system 10 and thereafter ensure that the proper firing circuit is actuated. The automatic selection and actuation of the appropriate firing circuit dispenses with the need for the user to manually select the appropriate firing circuit. In addition, by automatically firing the appropriate firing circuit, the detector system 44 eliminates the possibility that the user will have inadvertently selected the wrong firing circuit.

Still other advantages are associated with the discharge system 46. For example, the discharge system 46 may be used to discharge the electrical energy storage device 36, e.g., capacitor 38, thereby preventing unwanted energy storage within the electronic firing system 10. Eliminating unwanted energy storage provides for increased safety against inadvertent and/or accidental firings. In one embodiment, the discharge system 46 may comprise active and passive elements to provide additional assurance against unwanted energy storage.

The use of the control system 50 to control the function and operation of the various systems and components comprising the electronic firing system 10 provides additional advantages. For example, in one embodiment, the charging system 48 is actuated by the control system 50, rather than being actuated directly by a user. Such indirect control of the charging system 48 allows for increased control of the charging process and for the provision of additional fail-safe measures, such as, for example, the ability to delay the charging process as long as possible during the countdown process as well as to terminate the charging process after it has begun.

Having briefly described the electronic firing system 10 as well as some of its more significant features and advantages, various embodiments of the electronic firing system and methods for firing a device will now be described in detail. However, before proceeding with the description, it should be noted that the electronic firing system and methods according to the present invention are shown and described as they could be implemented to fire either a shock tube or a blasting cap. However, other types of devices that are now known in the art or that may be developed in the future could also be fired or initiated, as would become apparent to persons having ordinary skill in the art after having become familiar with the teachings provided herein. Consequently, the method and apparatus of the present invention should not be regarded as limited to the particular components, environments, and operational sequences shown and described herein.

Referring back now to FIGS. 1 and 2, one embodiment of an electronic firing system 10 may comprise a housing 12 sized to receive the various systems and components comprising the electronic firing system 10. In one embodiment, housing 12 comprises a generally rectangularly-shaped structure having a front panel 56 sized to accommodate the user input system 14 as well as the display system 18. A side panel 58 may be sized to receive the output connectors 22 of electronic firing system 10, as well as arm key 34. Alternatively, housing 12 could comprise other shapes and the various components could be arranged in other configurations, as would become apparent to persons having ordinary skill in the art after having become familiar with the teachings provided herein. Consequently, the present invention should not be regarded as limited to the particular configurations shown and described herein.

The housing 12 may be constructed from any of a wide range of materials (e.g., metals, plastics, or combinations thereof) suitable for the intended application. By way of example, in one embodiment, the housing 12 is fabricated from ABS plastic.

The user input system 14 may comprise any of a wide range of systems and devices suitable for allowing a user to provide the appropriate input signals to the electronic firing system 10, e.g., to set the countdown time and provide any other desired user inputs. By way of example, in one embodiment, the user input system 14 comprises a membrane-type keypad comprising a plurality of keys 16. In the embodiment illustrated in FIG. 1, the user input system 14 comprises a "set" key, a tens of minutes key "10," a ones of minutes key "1," a tens of seconds key "10," and a ones of seconds key "1." The keys 16 may be used in accordance with the descriptions provided herein to set the countdown time and to control various other functions and operations of the electronic firing system 10.

The display system 18 may comprise any of a wide range of systems and devices suitable for displaying the desired information. By way of example, in one embodiment, the display system 18 comprises a 7-segment LED display 20 for displaying the selected countdown time as well as various error messages and codes, as will be described below. Display system 18 may also be provided with a separate "charging" LED to indicate the status of the charging operation, as will also be described in greater detail below.

As mentioned above, the housing 12 of electronic firing system 10 may also be provided with one or more output terminals or connectors 22 to allow a device to be fired or initiated to be connected to the electronic firing system 10. In the embodiments shown and described herein, the electronic firing system 10 is designed to fire either a shock tube 30 or a blasting cap 32 (both of which are illustrated schematically in FIG. 2). Consequently, one of the output connectors 22 comprises a shock tube connector 24, whereas the other of the output connectors 22 comprises a blasting cap connector 26. See FIG. 1. Shock tube connector 24 may comprise any of a wide variety of connectors known in the art for use with shock tubes, thus will not be described in further detail herein. Similarly, blasting cap connector 26 may comprise any of a wide variety of connectors known in the art that are suitable for making electrical contact with wire leads (not shown) associated with the blasting cap 32. Consequently, blasting cap connector 26 should not be regarded as limited to any particular type of connector. However, by way of example, in one embodiment, blasting cap connector 26 comprises an insulation-displacement type of connector which is designed to displace (i.e., cut-through) the insulation on the wire lead as the wire lead is inserted in the connector 26. Such insulation-displacement connectors eliminate the need to first strip-off the insulation from the wire lead.

Side panel 58 of housing 12 may also be provided with an arm key 34. Arm key 34 is used to turn the electronic firing system "on" and "off" and also to initiate the countdown process after the desired countdown time has been selected. In the embodiment shown and described herein, the arm key 34 is rotatable in the clockwise direction (i.e., in the direction indicated by arrow 52 in FIG. 5) to turn "on" the electronic firing system 10. Arm key 34 may also be removed from the electronic firing system 10 (i.e., in the direction indicated by arrow 54 in FIG. 6) to initiate the countdown process. The countdown process may be terminated by re-inserting the arm key 34 into the housing 12, as will be described in greater detail below.

Other arrangements and operational configurations for the arm key 34 are possible. For example, in another embodiment, the arm key may be configured so that it may be pulled-out to turn-on the electronic firing system and pushed-in to turn it off. The arm key may arm the system when the key is pulled-out by turning the key. While the key is turned, thus arming the system, it cannot be pushed-in, thereby turning the system off. Still other arrangements and operational configurations for the arm key 34 are possible, as would become apparent to persons having ordinary skill in the art after having become familiar with the teachings provided herein. Consequently, the present invention should not be regarded as limited to arm keys having the particular arrangements and operational configurations shown and described herein.

Figure 3:
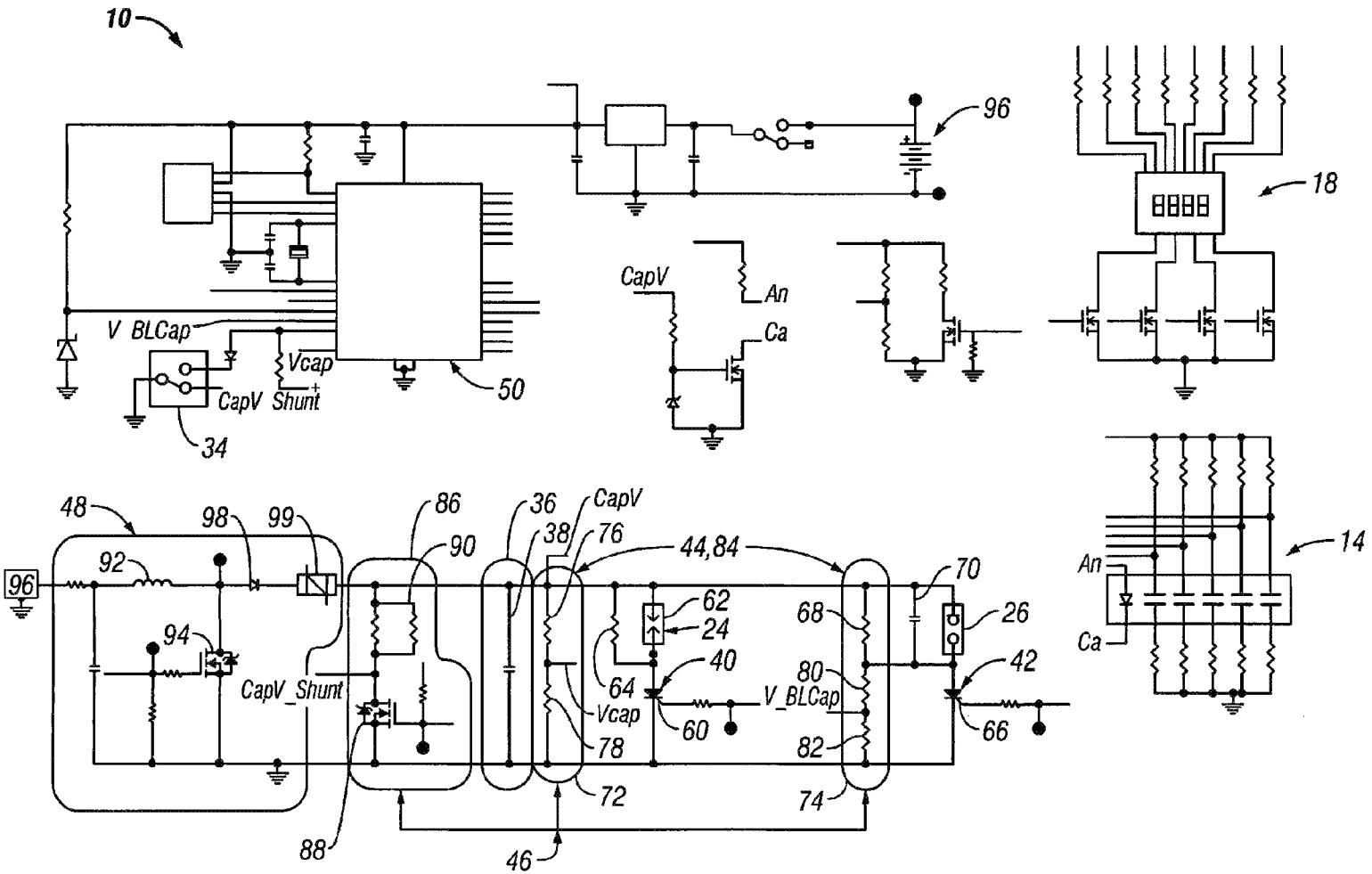
FIG. 3 is an electrical schematic of one embodiment of the electronic firing system.

Referring now primarily to FIGS. 2 and 3, the electronic firing system 10 may comprise a number of additional systems and components which may be provided inside housing 12. For example, electronic firing system 10 may further comprise an electrical energy storage system 36, such as one or more capacitors 38. The electrical energy storage system 36 is used to store an amount of electrical energy sufficient to fire or initiate the desired device. By way of example, in one embodiment wherein the electronic firing system 10 is configured to fire a "standard" shock tube 30 (e.g., a shock tube having a diameter in a range of about 2 mm to about 3.8 mm) and a "standard" blasting cap 32, the energy storage system 36 is sized to that it may store up to about 4 joules of electrical energy. If a capacitor or capacitors 38 are used as the electrical energy storage system 36, a total capacitance of about 200 micro-farads (μF) at a voltage of about 200 volts will provide about 4 joules of electrical energy.

The electrical energy stored in the energy storage system 36 is electrically connected to the device to be fired 28 via one or more firing circuits. A firing device is a device that electrically connects the electrical energy storage device to the device to be fired 28 at the direction of the control system 50. Any electrical or mechanical switch may be used, for example, transistors (e.g. BJT's MOSFETS, etc.), mechanical relays, solid state relays, silicon controlled rectifier (SCR), or any other switching means may be used. In one embodiment, the electronic firing system 10 is provided with a shock tube firing circuit 40 and a blasting cap firing circuit 42. Referring now to FIG. 3, shock tube firing circuit 40 may comprise a silicon controlled rectifier (SCR) 60 the series combination with a spark gap 62 (part of the shock tube connector 24) of which is connected across capacitor 38. Preferably, the spark gap 62 is provided within the shock tube connector 24, so that a shock tube 30 connected thereto may be initiated by a spark developed across spark gap 62.

In one embodiment, spark gap 62 is not an open-air spark gap, but rather comprises a thermoplastic "header" of the type suitable for initiating shock tubes. More specifically, the thermoplastic header comprises a pair of wires embedded in a plastic material, such as polyphenylene sulfide. When the firing voltage is applied to the embedded wires, current begins to flow in the plastic, causing it to break-down, which decreases the resistance of the plastic, leading to avalanche breakdown of the plastic. The result is the formation of a spark of sufficient energy to initiate the shock tube. By way of example, in one embodiment, the thermoplastic header comprising spark gap 62 may comprise an RP-87 bridge head manufactured by Teledyne RISI, Inc. (USA). Alternatively, other types of headers available from other manufacturers may be used as well.

Continuing now with the description, the anode of SCR 60 is connected to a first terminal of spark gap 62. A second terminal of spark gap 62 is connected a first plate of capacitor 38. The cathode of SCR 60 is connected to a second plate of capacitor 38. The gate of SCR 60 is operatively connected to the control system 50 which is configured to provide a suitable "on" command or signal to SCR 60 when the countdown reaches zero. A resistor 64 connected in parallel with spark gap 62 provides forward bias to SCR 60. Thus, when SCR 60 is turned on or "fired" in response to the command from control system 50, the capacitor 38 will be connected across the spark gap 62, resulting in the formation of a spark of sufficient energy to initiate or fire a shock tube 30 connected to shock tube connector 24.

The blasting cap firing circuit 42 may comprise an SCR 66 connected in series with blasting cap connector 26. More specifically, the anode of SCR 66 is connected to a first terminal of blasting cap connector 26, whereas a second terminal of blasting cap connector 26 is connected to the first plate of capacitor 38. The cathode of SCR 66 is connected to the second plate of capacitor 38. The gate of SCR 66 is operatively connected to the control system 50 which is configured to provide a suitable "on" signal or command to SCR 66 when the countdown reaches zero. A resistor 68 connected in parallel with blasting cap connector 26 provides forward bias to SCR 66. A capacitor 70 also connected in parallel with blasting cap connector 26 provides transient suppression. When SCR 66 is turned on or "fired" in response to the command from control system 50, the capacitor 38 will be connected across the terminals of blasting cap connector 26, thereby providing the electrical energy required to initiate or fire a blasting cap 32 electrically connected to blasting cap connector 26.

Detector system 44 may comprise a pair of voltage divider networks 72 and 74 connected across capacitor 38. More specifically, a first voltage divider network 72 may comprise first and second resistors 76 and 78 connected in series across capacitor 38. Second voltage divider network 74 may comprise three resistors 68, 80, and 82 connected in series across capacitor 38. See FIG. 3. Note that resistor 68 is also connected in parallel with the first and second terminals of blasting cap connector 26. The arrangement is such that the total resistance of resistors 68 and 80 is about equal to the resistance of resistor 76 of first voltage divider network 72. Similarly, the resistance of resistor 80 should be about equal to the resistance of resistor 78 of first voltage divider network 72.

The control system 50 is operatively connected to the node ("Vcap") between resistors 76 and 78, the node ("CapV") between resistor 76 and capacitor 38, as well as the node ("VBLCap") between resistors 80 and 82. If no blasting cap 32 is connected across the terminals of blasting cap connector 26, the voltages at the nodes Vcap and VBLCap will be substantially identical, owing to the balanced configuration of the two voltage divider networks 72 and 74. However, if a blasting cap 32 (typically having a resistance of about 2 ohms) is connected across the terminals of the blasting cap connector 26, the voltages at nodes Vcap and VBLCap will not be substantially equal. The control system 50 is configured to recognize this voltage difference, thus determine whether a blasting cap 32 is connected to the blasting cap connector 26.

The various resistors 68, 76, 78, 80, and 82 comprising the first and second voltage divider networks 72 and 74 may comprise any of a wide range of resistances, provided they form balanced voltage divider networks 72 and 74 in the manner already described. However, and as will be described in further detail below, because first and second voltage divider networks 72 and 74 together also comprise a passive shunt 84 of discharge system 46, the resistances of first and second voltage divider networks 72 and 74 should be selected so as to also provide an appropriate degree of resistance for the passive shunt 84 of discharge system 46. By way of example, in one embodiment, resistor 68 comprises a resistance of about 330 kilo-ohms (kΩ), whereas resistor 76 comprises a resistance of about 1 mega-ohms (MΩ). Resistor 80 may then be provided with a resistance of about 680kΩ, so that the series resistance of resistors 68 and 80 is about 1 MΩ. Resistors 78 and 82 may both have resistances of about 10 kΩ.

As mentioned above, electronic firing system 10 may also be provided with a discharge system 46 for discharging electrical energy stored in electrical energy storage system 36. In one embodiment, discharge system 46 comprises a passive discharge portion or passive shunt 84 and an active discharge portion or active shunt 86. In one embodiment, the passive shunt 84 of discharge system 46 comprises the two voltage divider networks 72 and 74, as they are connected across the first and second plates of capacitor 38, thus serve to discharge capacitor 38 over time.

Active shunt 86 may comprise field effect transistor (FET) 88 or other suitable switching device and a current-limiting resistor or resistors 90, the series combination of which is connected across capacitor 38. The gate of FET 88 is operatively connected to control system 50 which is configured to provide a suitable "on" signal or command to FET 88 when it is desired to rapidly discharge capacitor 38 via the resistor 90. In addition, a switch 34' (FIG. 3) operatively associated with arm key 34 may be connected in parallel with FET 88, so that when arm key 34 is inserted, switch 34' will close, thus shorting capacitor 38 via resistor 90. That is, resistor 90 will always be connected across capacitor 38 whenever the arm key 34 is inserted.

Resistor 90 may comprise any of a range of resistances suitable for discharging capacitor 38 at the desired rate and for also limiting the discharge current to a safe level. By way of example, in one embodiment, resistor 90 comprises a pair of 200 ohm (Ω) resistors connected in parallel.

Charging system 48 may be used to charge the electrical energy storage system 36 (e.g., capacitor 38) so that it will contain sufficient energy to initiate the device to be fired 28. Preferably, the Charging system 48 is a switched mode converter, for example a buck, boost, buck-boost, split-pi, Ćuk, SEPIC, Zeta, or charge pumped converter. In one embodiment, charging system 48 may comprise a boost converter circuit comprising an inductor 92 and an FET 94, the series combination of which is connected across a dc voltage (e.g., provided by battery 96). Capacitor 38 is connected in parallel with FET 94 via diode 98, as best seen in FIG. 3. The gate of FET 94 is operatively connected to the control system 50 which provides a pulsed gate signal to FET 94 to cause the same to be switched on and off. An avalanche diode 99 may be connected in series between the diode 98 and the capacitor 38 to block battery voltage form being applied on the shock tube connector 24 and the blasting cap connector 26 without the charging circuit being activated.

FET 94 may be switched between the "on" and "off" states at any of a wide range of frequencies and duty cycles (e.g., the ratio between the "on" time and the "off" time) in order to charge capacitor 38 in the desired time and to the desired potential. In one embodiment wherein the electronic firing system 10 is provided with a passive shunt 84, as described above, the switching frequency and duty cycle for FET 94 should be such that the charging system 48 will charge the capacitor 38 at a rate much faster than it is discharged by passive shunt 84 and at a rate that will allow the capacitor 38 to be fully charged before the countdown reaches zero. By way of example, in one preferred embodiment, FET 94 is switched between the "on" and "off" states at a frequency of about 10 kilohertz (kHz). The "on" time is about 95 microseconds (μs), and the "off" time is about 5 μs. If the voltage of battery 96 is about 9 volts, these switching times will be capable of charging the capacitor 38 to a voltage of about 200 volts or higher, which is sufficient to initiate a shock tube 30 or a blasting cap 32.

Control system 50 may comprise any of a wide range of control systems suitable for operating the various systems and components of the electronic firing system 10 in accordance with the teachings provided herein. Consequently, the present invention should not be regarded as limited to any particular type of control system 50. However, by way of example, in one embodiment, control system 50 may comprise an 8-bit CMOS FLASH microcontroller, such as type PIC16F72, which is available from Microchip Technology, Inc., of Chandler, Ariz. (US). The microcontroller may be programmed to operate the various systems in the manner described herein.

Referring now to FIGS. 3 and 4 simultaneously, the electronic firing system 10 may be operated as follows to initiate or fire a device to be fired 28 (e.g., a shock tube 30 or a blasting cap 32). When the electronic firing system 10 is first powered on, the control system 50 may first measure the actual voltage of the battery 96. In one embodiment, battery 96 may comprise a conventional 9 volt alkaline battery, which, when "fresh," typically develops a voltage of about 9.5 volts. The microcontroller of control system 50 may be programmed to look for a battery voltage of at least 7.5 volts. If control system 50 does not find at least 7.5 volts then the processing stops and a low battery error message is displayed on display system 18. The user will not be able to proceed further, except to turn off the electronic firing system 10.

If the voltage of battery 96 is determined to be 7.5 volts or more, control system 50 may then simultaneously turn-on all of the segments of the LED display 20, thereby applying a test load on the battery 96. It is possible that though the initial battery test may succeed, the battery 96 may be so drained that it does not have the capacity to operate the electronic firing system 10 for any length of time. This test load is applied to the battery 96 for some period of time (e.g., about two seconds). Control system 50 may again measure the voltage of battery 96. If the battery voltage has dropped to 6.6 volts or below, then less than 20% of the original battery capacity remains. If this is the case, the processing stops and an error message is displayed on display system 18. The operator will not be able to proceed further, except to turn off the electronic firing system 10.

After these two battery checks, the control system 50 may be configured or programmed to display a default delay or countdown time on the display system 18. Control system 50 will await user input from the front panel keys 16, as well as the removal of the arm key 34. At this point the user may select the default countdown time or may program a different countdown time by actuating the various keys 16. In any event, the countdown time will be shown on the LED display 20.

The default countdown time as well as the user-programmable countdown time may be selected to be any of a wide range of times suitable for the intended application. By way of example, in one embodiment, the default countdown time is 2 minutes, 30 seconds. The user-programmable countdown time may be selected to be a maximum of 59 minutes, 59 seconds, and a minimum of 15 seconds.

A first passive safety exists when the arm key 34 is fully inserted. That is, when arm key 34 is fully inserted, a low-resistance shunt (formed by resistor 90 and closed switch 34') is physically placed across capacitor 38, thereby preventing a charge from building on capacitor 38. This low-resistance shunt will also discharge any charge that may have accumulated on capacitor 38 if the arm key 34 was removed. A second passive safety is the high resistance or passive shunt 84 that exists across capacitor 38 at all times. Passive shunt 84 prevents any charge from remaining in the capacitor 38 over a period of time.

As mentioned, the electronic firing system 10 may also be provided with an active shunt 86 that is operable by the control system 50. From the time that the electronic firing system 10 is turned on until the time the control system 50 begins to charge the capacitor 38, the active shunt 86 is closed, which also prevents any charge from building on the capacitor 38 even if arm key 34 is removed. The combination of the passive and active shunts 84 and 86, as described herein, create a situation in which it is either not possible to build a charge on the capacitor 38, or when a charge is being built, it is actually in a race to build sufficient charge and hold it faster than the charge is being drained via the passive (i.e., high resistance) shunt 84.

After the desired countdown time has been selected, e.g., via keys 16 and confirmed on LED display 20, the user must then remove the arm key 34. Removal of arm key 34 does two things. First, it physically removes one of the shunts across capacitor 38 (i.e., by opening switch 34'). Second, the changed state of switch 34' is detected by control system 50. At this point, control system 50 initiates the countdown and ignores any further input from the user input system 14. Control system 50 holds the active shunt 86 closed until the countdown reaches one minute (or less if the time set is less than one minute). The control system 50 then opens the active shunt 86 and begins driving the charging circuit 48 to charge capacitor 38. As mentioned, the pulse duration and frequency of the signal applied to FET 88 must be such that the charging circuit 48 charges capacitor 38 at a rate that is greater than the rate at which capacitor 38 is discharged by the passive (i.e., high-resistance) shunt 84. That is, the charge rate provided by the charging circuit 48 must be greater than the discharge rate through passive shunt 84. The charge rate should also be sufficiently high so that capacitor 38 will be fully charged before the countdown reaches zero.

Once the voltage across capacitor 38 reaches 200 volts, for example, the control system 50 modulates (i.e., turns on and off) the charging circuit 48 to maintain the voltage of capacitor 38 at about 200 volts. The control system 50 may determine the voltage on capacitor 38 by monitoring the voltage on node Vcap. At any time during the countdown the user can reinsert the arm key 34. Reinserting the arm key 34 will do two things. First, it physically returns a low resistance shunt across capacitor 38, discharging it via resistor 90. Second, reinsertion of arm key 34 closes a switch 34' (FIG. 3) which is detected by control system 50. Control system 50 then stops the countdown and changes to an operational state where the user can modify or re-set the countdown time. In the event the control system 50 is unable to detect the reinsertion of arm key 34 (i.e., by detecting the changed state of switch 34'), the reinsertion of the arm key 34 will return the low resistance shunt across the capacitor 38, discharging it via resistor 90 and thus preventing any further accumulation of charge.

Under normal circumstances, e.g., when the arm key 34 is not reinserted, control system 50 will continue the countdown to zero, maintaining the voltage on capacitor 38 at about the desired firing voltage (e.g., about 200 volts) by monitoring the voltage at node Vcap and by modulating the charging system 48 in the manner already described. At this time, the control system 50, operating in conjunction with the detector system 44, determines whether a blasting cap 32 is connected to the blasting cap connector 26. Such detection is accomplished by comparing the voltages at the various nodes of the first and second voltage divider networks 72 and 74. That is, if the voltage at node VBLCap is about equal to the voltage at node Vcap, then the control system 50 concludes that no blasting cap 32 is connected. Thus, when the countdown reaches zero, the control system 50 will actuate or fire the shock tube firing circuit 40. Alternatively, if the voltage at node VBLCap is not equal to the voltage at node Vcap, then the control system 50 concludes that a blasting cap 32 is connected to blasting cap connector 26. The control system 50 will then actuate or fire the blasting cap firing circuit 42 when the countdown reaches zero. After firing, the control system 50 then displays an indication that it fired, and what it fired (e.g., either the shock tube firing circuit 40 or the blasting cap firing circuit 42). Control system 50 also stops driving the charging circuit 48, and re-establishes the active shunt 86 across the capacitor 38.

Optionally, just before firing the appropriate firing circuit (e.g., either the shock tube firing circuit 40 or the blasting cap firing circuit 42), the control system 50 may measure the voltage on built-up on capacitor 38 via the voltage at the Vcap node. In one embodiment, the voltage on capacitor 38 should be at least 160 volts. If the voltage on capacitor 38 is at least 160 volts, the control system 50 will actuate the appropriate firing circuit in the manner already described. If the voltage is less than about 160 volts, the control system 50 will still actuate the appropriate firing circuit, but will also display a low battery indication on display system 18. Such an error indicates that the battery 96 should be replaced before an attempt is made to fire again at the same countdown setting or a longer countdown setting. In the event that the energy was not sufficient to initiate a detonation, control system 50 may provide an indication of the likely cause (e.g., a low battery).

once more the voltage of battery 96. So measuring the voltage of battery 96 will enable a determination of how far the battery 96 was drained during the countdown process. If the voltage of battery 96 is determined to be less than about 6.6 volts, control system 50 will display a low battery signal instead of a fire indication. In this event, control system 50 will not prevent the actuation of the appropriate firing circuit. Rather, control system 50 will simply display the low battery indication meaning that the battery 96 should be replaced before attempting to fire again.

After firing, the control system 50 no longer responds to any input from the user input system 14 or the arm key 34. The electronic firing system 10 must be turned of and on to begin another fire sequence. This is to force a system check before a countdown can be initiated again.

Having herein set forth preferred embodiments of the present invention, it is anticipated that suitable modifications can be made thereto which will nonetheless remain within the scope of the invention. The invention shall therefore only be construed in accordance with the following claims:

The invention claimed is:

1. An electronic firing system, comprising:

a) a control system, a charging system, an electrical energy storage device, a shock tube firing circuit, a shock tube connector, a blasting cap firing circuit, and a blasting cap connector;

b) said control system connected to said charging system;

c) said electrical energy storage device electrically connected to said charging system;

d) said shock tube firing circuit electrically connected to said charging system and said shock tube connector; and e) said blasting cap firing circuit electrically connected to said charging system and said blasting cap connector.

2. The electronic firing system of claim 1 further comprising:

a) a detector system;

b) said detection system electrically connected to said blasting cap connector; and c) said detector system detecting the electrical resistance across said blasting cap connector.

3. The electronic firing system of claim 2, wherein said detection system comprises:

a) a first voltage divider connected in parallel with said electrical energy storage device;

b) said first voltage divider comprising a first resistor and a second resistor electrically connected in series;

c) said control system electrically connected to the connection between said first resistor of said first voltage divider and said second resistor of said first voltage divider;

d) a second voltage divider connected in parallel with said electrical energy storage device;

e) said second voltage divider comprising a first resistor, a second resistor, and a third resistor electrically connected in series;

f) said first resistor of said second voltage divide connected in parallel said blasting cap connector; and g) said control system electrically connected to the connection between said first resistor of said second voltage divider and said second resistor of said second voltage divider.

4. The electronic firing system of claim 3, wherein:

a) said first resistor of said first voltage divider, said second resistor of said first voltage divider, said first resistor of said second voltage divider, said second resistor of said second voltage divider, and said third resistor of said second voltage divider are selected to discharge said electrical energy storage device at a rate less than the charging rate of said charging system.

5. The electronic firing system of claim 4, wherein:

a) said control system measuring the electrical voltage between said first resistor of said first voltage divider and said second resistor of said first voltage divider;

b) said control system measuring the electrical voltage between said first resistor of said second voltage divider and said second resistor of said second voltage divider;

c) said control system using the difference in measured voltages between said first voltage divider and said second divider to detect the presence of a blasting cap at said blasting cap connector; and d) said electronic firing system using said first voltage divider and said second voltage divider to passively discharge said electrical energy storage device.

6. The electronic firing system of claim 5, wherein:

a) said first resistor of said first voltage divider has an electrical resistance about equal to the electrical resistance of said first resistor of said second voltage divider and said second resistor connected in series; and b) said second resistor of said first voltage divider has an electrical resistance about equal to the electrical resistance of said third resistor of said second voltage divider.

7. The electronic firing system of claim 6, wherein:

a) said first resistor of said first voltage divider has an electrical resistance of about 1 mega-ohms;

b) said second resistor of said first voltage divider has an electrical resistance of about 10 kilo-ohms;

c) said first resistor of said second voltage divider has an electrical resistance of about 330 kilo-ohms;

d) said second resistor of said second voltage divider has an electrical resistance of about 680 kilo-ohms; and e) said third resistor of said second voltage divider has an electrical resistance of about 10 kilo-ohms.

8. The electronic firing system of claim 1, wherein said electrical energy storage device comprises at least one capacitor.

9. The electronic firing system of claim 1, further comprising:

a) a discharge system electrically connected to said electrical energy storage device and connected to said control system; and b) said discharge system having a means for electrically discharging said electrical energy storage device.

10. The electronic firing system of claim 9, wherein said discharge system comprises an active shunt operatively connected to said control system whereby said control system operates said active shunt to cause said active shunt to electrically discharge said electrical energy storage device.

11. The electronic firing system of claim 10, wherein said active shunt comprises:

a) a field effect transistor and a current limiting resistor;

b) said field effect transistor and said current limiting resistor electrically connected in series across said electrical energy storage device; and c) said control system connected to said field effect transistor.

12. The electronic firing system of claim 11, further comprising:

a) said field effect transistor comprising a gate;

b) an arm key electrically connected to said gate of said field effect transistor, whereby said field effect transistor is controlled by said arm key; and c) said control system electrically connected to said gate of said field effect transistor whereby said field effect transistor is controlled by said control system in addition to said arm key.

13. The electronic firing system of claim 9, wherein:

a) said discharge system comprises a passive shunt;

b) said passive shunt having a discharge rate of discharging said electrical energy storage device;

c) said charging system having a charging rate of charging said electrical energy storage device; and d) said discharge rate less than said charging rate.

14. The electronic firing system of claim 1, wherein said charging system comprises:

a) an inductor, a switch, and a diode;

b) said inductor and said switch connected in series across a voltage source;

c) said diode having a first end and a second end;

d) said first end of said diode connected between said inductor and said switch; and e) said second end of said diode connected to said electrical energy storage device.

15. The electronic firing system of claim 1, wherein:

a) said shock tube firing circuit consisting a single silicon controlled rectifier (SCR); and b) said single silicon controlled rectifier (SCR) electrically connected to said control system, said electrical energy storage device, and said shock tube connector.

16. The electronic firing system of claim 1, wherein:

a) said blasting cap firing circuit consisting a single silicon controlled rectifier (SCR); and b) said single silicon controlled rectifier (SCR) electrically connected to said control system, said electrical energy storage device, and said blasting cap connector.

17. The electronic firing system of claim 6, wherein:

a) said control system comprising a display and a user input for selecting a countdown time; and b) said control system initiating a countdown at the direction of a user; signaling said charging system to charge said electrical energy storage system while performing the countdown; and signaling said shock tube firing circuit to energize said shock tube connector or signaling said blasting cap firing circuit to energize said blasting cap connector when said countdown reaches zero.

18. The electronic firing system of claim 6, further comprising:

a) an active shunt operatively connected to said control system whereby said control system operates said active shunt to cause said active shunt to electrically discharge said electrical energy storage device;

b) said active shunt comprises:

i) a field effect transistor and a current limiting resistor; and ii) said field effect transistor and said current limiting resistor electrically connected in series across said electrical energy storage device;

c) said field effect transistor comprising a gate;

d) an arm key electrically connected to said gate of said field effect transistor, whereby said field effect transistor is controlled by said arm key; and e) said control system electrically connected to said gate of said field effect transistor whereby said field effect transistor is controlled by said control system in addition to said arm key.

19. The electronic firing system of claim 18, wherein:

a) said electrical energy storage device comprises at least one capacitor;

b) said charging system comprises: an inductor, a switch, and a diode;

c) said inductor and said switch connected in series across a voltage source;

d) said diode having a first end and a second end;

e) said first end of said diode connected between said inductor and said switch;

f) said second end of said diode connected to said electrical energy storage device;

g) said shock tube firing circuit consisting a single silicon controlled rectifier (SCR);

h) said single silicon controlled rectifier (SCR) of said shock tube firing circuit electrically connected to said control system, said electrical energy storage device, and said shock tube connector;

i) said blasting cap firing circuit consisting a single silicon controlled rectifier (SCR);

j) said single silicon controlled rectifier (SCR) of said blasting cap firing circuit electrically connected to said control system, said electrical energy storage device, and said blasting cap connector.

* * * * *